US007971657B2

(12) United States Patent
Hollier et al.

(10) Patent No.: US 7,971,657 B2
(45) Date of Patent: Jul. 5, 2011

(54) DRILL CUTTINGS TRANSFER SYSTEM AND RELATED METHODS

(75) Inventors: Glynn Hollier, The Woodlands, TX (US); Brett Boyd, Opelousas, LA (US)

(73) Assignee: Baker Hughes Incorporated, Houston, TX (US)

( * ) Notice: Subject to any disclaimer, the term of this patent is extended or adjusted under 35 U.S.C. 154(b) by 42 days.

(21) Appl. No.: 11/301,369

(22) Filed: Dec. 13, 2005

(65) Prior Publication Data

US 2007/0131454 A1 Jun. 14, 2007

(51) Int. Cl.
*E21B 21/01* (2006.01)

(52) U.S. Cl. ..... 175/66; 175/206; 175/207

(58) Field of Classification Search ..... 166/357, 166/267, 75.12; 175/66, 88, 207, 206
See application file for complete search history.

(56) References Cited

U.S. PATENT DOCUMENTS 5,122,038 A * 6/1992 Malkoski ..... 417/313
5,846,440 A * 12/1998 Angelle ..... 210/803
5,882,524 A * 3/1999 Storey et al. ..... 210/712
5,927,910 A * 7/1999 Fix, Jr. ..... 408/17
5,996,484 A 12/1999 Reddoch
6,170,580 B1 1/2001 Reddoch
6,179,071 B1 * 1/2001 Dietzen ..... 175/66
6,279,471 B1 8/2001 Reddoch
6,345,672 B1 * 2/2002 Dietzen ..... 175/66
6,527,054 B1 3/2003 Fincher et al.
6,585,115 B1 7/2003 Reddoch et al.
6,709,217 B1 3/2004 Snowdon
6,910,411 B2 6/2005 Reddoch
6,936,092 B2 * 8/2005 Seyffert et al. ..... 95/271
7,195,084 B2 * 3/2007 Burnett et al. ..... 175/66
2005/0183574 A1 * 8/2005 Burnett et al. ..... 95/271

OTHER PUBLICATIONS http://web.archive.org/web/20020724144650/http://www.glossary.oilfield.slb.com/Display.cfm?Term=shale+shaker.*

* cited by examiner

*Primary Examiner* — Kenneth Thompson
*Assistant Examiner* — Sean Andrish
(74) *Attorney, Agent, or Firm* — Mossman, Kumar and Tyler, PC

(57) ABSTRACT

A system for handling drill cuttings conveys cuttings slurry into bulk tanks via a conduit. The bulk tanks have an unpressurized interior volume that receives the slurry. A conveyance member positioned inside the bulk tank forces the slurry out of a discharge port at the bottom of the bulk tank. One suitable conveyance member is a screw-type conveyor coupled to a motor that applies a vertical motive force to the slurry. The bulk tanks hold the cuttings slurry until it can be discharged via the discharge port to a transport vessel for processing or disposal. For offshore operations, the system includes a separation unit on the rig that forms the cuttings slurry from fluid returning from the wellbore and a cuttings flow unit that conveys the slurry effluent from the separation unit to the bulk tanks. In one arrangement, a controller and sensors control the flow of slurry into the bulk tanks.

7 Claims, 5 Drawing Sheets

DRILL CUTTINGS TRANSFER SYSTEM AND RELATED METHODS

FIELD OF THE INVENTION

1. Field of the Invention

This invention relates generally to handling of waste materials especially particulate drill solids.

2. Background of the Invention

In the drilling of oil and gas wells, drilling fluids or "muds" are used to provide well bore lubrication, to cool the drill bit, to protect against corrosion and to provide a pressure head to maintain formation integrity. There are two main types of drilling muds: water-based and oil-based. Generally, surface pumps circulate drilling mud down the tubular drill string. The mud exits at the drill bit and flows up the annulus between the drill string and the bore. The returning fluid (or return fluid carries the drill cuttings away from the bit and out of the wellbore. Oil-based drilling muds are stable oil external-water internal emulsions including wetting agents to hold solids such as drill cuttings in the oil phase. The drill cuttings thus tend to become oil wet, trapping large quantities of oil-based mud in their intergranular spaces and creating environmental concerns regarding disposal of the oily contaminated drill cuttings.

In the prior art, drill cuttings contaminated with oil-based drilling muds were often collected in settling tanks where re-usable drilling mud was drawn off the top of the tank and contaminated drill cuttings, as bottoms, were transported to appropriate disposal sites. Such storage and transportation operations are costly and environmentally undesirable especially in offshore drilling operations. Typically, oil contaminated cuttings contain about fifty percent (50%) by volume of oil-based liquid. The value of this large volume of entrained oily liquids is considerable, and there is a strong economic incentive to recover the oil-based drilling mud both for economic as well as environmental reasons.

Accordingly the cuttings are commonly separated from the drilling fluid by devices such as a shale shaker, which remove cuttings and large solids from the drilling fluid during the circulation thereof. Basically, such a device has a sloping, close mesh, screen over which fluid returning from the hole being drilled passes. The solids captured on the screen travel down the sloping surface to be collected in the shaker ditch or cuttings trough. It is also desirable to recover as much of the expensive drilling fluids as possible. Therefore, other devices, which play a role in the separation of solids from drilling fluids, include cyclone separators, and centrifuges. The cuttings discharged from the shakers, cyclone's and centrifuges that are collected in the shaker ditch or cuttings trough are still highly contaminated with the drilling fluids and therefore form a slurry or heavy sludge. Typically the slurry is conveyed into containers or skips, which are then periodically moved by crane from the rig onto a vessel.

This process is disadvantageous for a number of reasons. First, the skips take up considerable valuable space on the rig floor. Moreover, the handling of the skips requires the use of the rig crane, which may divert the crane from other important duties. One prior art device uses a pneumatic conveyance arrangement to the convey materials that are in the form of thick heavy pastes. It is believed that one drawback of such arrangements is the need for containers having sufficient strength to hold pressurized contents. Suitable containers will typically be heavy and expensive due to the need for metal components strong enough to safely hold elevated pressure conditions.

The present invention addresses these and other drawbacks of the prior art.

SUMMARY OF THE INVENTION

In aspects, the present invention provides efficient systems and methods for handling drill cuttings that are generated while drilling hydrocarbon-producing wellbores. Theses cuttings as noted earlier are entrained in a drilling fluid returning from the wellbore (return fluid). After the return fluid is separated to form a cuttings slurry, the cuttings slurry is conveyed into one or more bulk tanks via a conduit such as hoses, pipes or tubing. The bulk tank has an un-pressurized interior volume that receives and holds the slurry. When needed, a discharge port on the bulk tank is opened to allow the slurry to exit the bulk tank. The bulk tanks hold the cuttings slurry until it can be discharged to a transport vessel or vehicle for processing and/or disposal. The transport vessel or vehicle can have a bank of containers adapted to receive the slurry from the bulk tanks.

Because the slurry is very viscous and may not flow under the weight of gravity alone, a conveyance member position inside the bulk tank applies a motive force to the slurry body that causes the slurry body to flow out of the bulk tank discharge port. In embodiments, the conveyance member can be configured to mix the slurry before causing the slurry to flow out of the tanks. In one embodiment, the conveyance member is a device that pushes the slurry through the discharge port. One such suitable device includes a vertically mounted screw-type conveyor coupled to a motor.

In other embodiments, the bulk tank has a cylindrical body with a substantially flat bottom. To expel cuttings from the bulk tank, a multi-action cuttings conveyor is positioned inside the bulk tank. In one embodiment, the conveyor includes a rotating arm that sweeps across a bottom interior surface of the bulk tank to dislodge and agitate cuttings. An auger-type device mounted along the arm pushes or actively urges these dislodged cuttings radially toward the discharge port or ports of the bulk tank. In another embodiment, one or more cuttings flow control elements are positioned along a bottom interior surface of the bulk tank. The cuttings flow control element can be conically shaped members that have highly inclined surfaces that channel cuttings toward the discharge port or ports. Thus, the flow control elements minimize the horizontal surface area on which cuttings can mass as well as focus the gravity drainage of the cuttings.

In one arrangement suited for offshore operations, the system includes a separation unit on the rig that forms the cuttings slurry. The separation unit can include one or more shakers, centrifuge-type separators and/or other suitable devices. A cuttings flow unit conveys the slurry effluent from the separation unit to the bulk tanks or other selected location. The cuttings flow unit can include, for example, an auger type conveyor and pump or blower device to flow the slurry and one or more diverter valves that can direct the slurry flow as needed. In one arrangement, a controller controls the flow of slurry into the plurality of bulk tanks. Sensors positioned on each of the bulk tanks produce signals indicative of the volume of slurry in an associated bulk tank. The controller controls the flow of slurry in response to the sensor signals. The bulk tanks can be filled simultaneously, sequentially or by any other scheme.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE FIGURES

For detailed understanding of the present invention, reference should be made to the following detailed description of the preferred embodiment, taken in conjunction with the accompanying drawing.

DETAILED DESCRIPTION OF THE INVENTION

Figure 1:
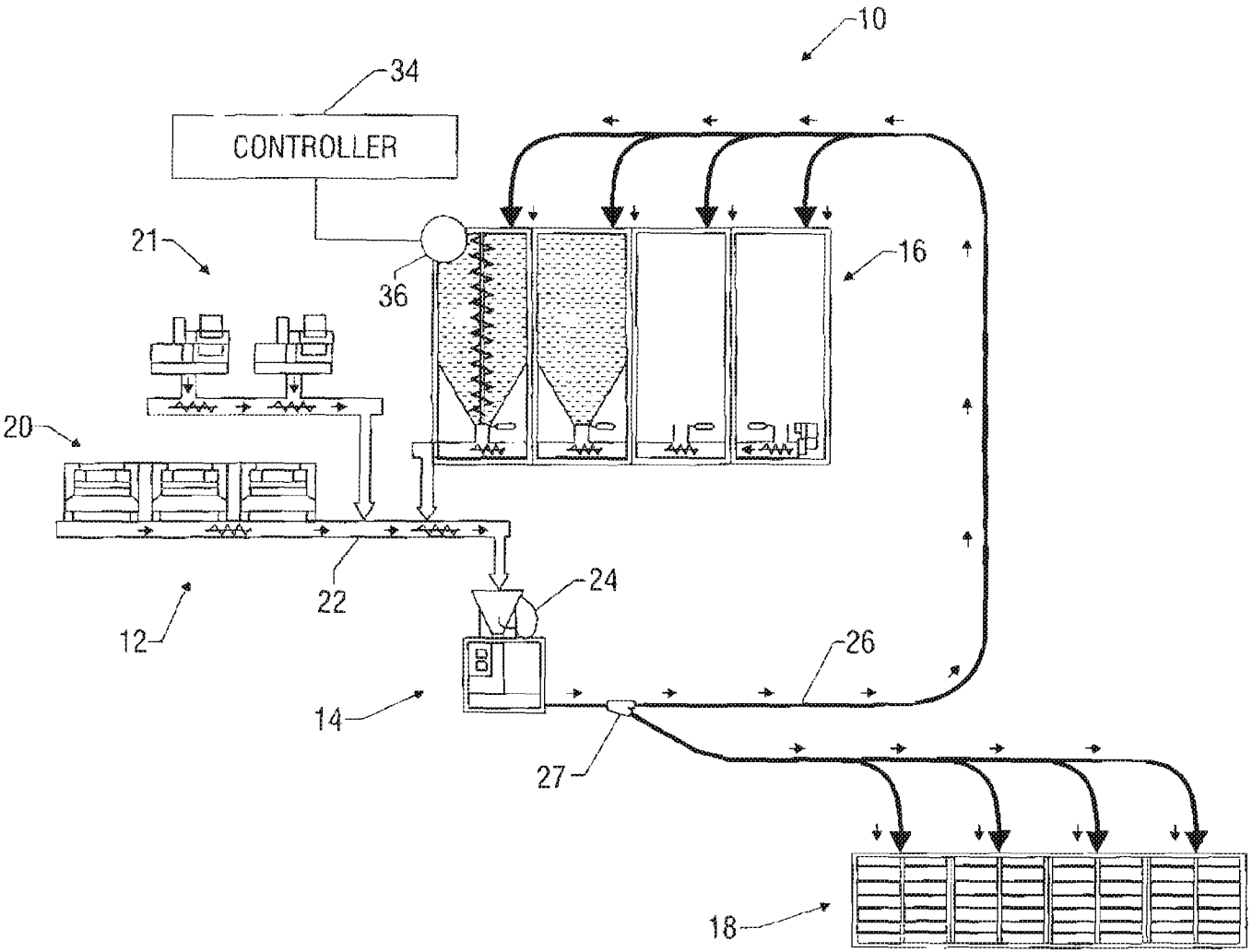
FIG. 1 schematically illustrates a system for processing, storing and offloading drill cuttings made in accordance with one embodiment of the present invention.

As shown in FIG. 1, in one embodiment particularly suited for use on an offshore drilling rig, a cuttings handling system 10 includes a separation unit 12, a cutting flow unit 14, and one or more bulk tanks 16. The system offloads the cuttings to one or more suitable container 18 on a transport vessel (not shown). In one mode of operation, the system receives return fluid, which has entrained cuttings, from a wellbore being drilled. The separation unit 12 separates some of the drilling fluid from the return fluid for re-use in further drilling and forms the cutting slurry. The cuttings slurry is conveyed by a cuttings flow unit 14 to the bank of bulk tanks 16. After the bulk tanks 16 are fully charged with cuttings, the cuttings are expelled from the bulk tanks 16 and conveyed by the cuttings flow unit 14 to the container(s) 18 of the transport vessel (not shown). Thus, in contrast to conventional cuttings handling arrangements, human intervention is not needed to collect, store and move drill cuttings on a rig. The elements making up the FIG. 1 embodiment are discussed in further detail below.

The separation unit 12 extracts the relatively expensive drilling fluid from the return fluid. In one arrangement, the separation unit 12 can include one or more shale shakers 20. Within the shale shaker 20, the return fluid and entrained solids are discharged over a vibratory separator that has one or a series of tiered screens. The screens catch and remove solids from the return fluid flowing therethrough. The separation unit 12 can also include other separation devices such as a centrifugal separator 21 that are also configured to extract drilling fluid from the cuttings. Such separation devices and techniques are known in the art and will not be discussed in further detail. The effluent or output of the separation unit 12 is relatively viscous slurry make up of oil or additive covered rock, earth and debris. This slurry is usually not free flowing and, therefore, requires a conveyance mechanism to induce flow.

The cuttings flow unit 14 is configured transport the slurry from the separation unit 12 to other devices such as the bulk tanks 16 or vessel storage tanks 18. In one embodiment, the cuttings flow unit 14 includes an auger-type device 22 that continually conveys the slurry to a dense phase blower 24 that impels the slurry through a conduit 26 such as piping or hoses to the bulk tanks 16 or vessel storage tanks 18. Suitable valves such as a diverter valve 27 can be used in the conduit 26 to selectively direct flow of the slurry.

Figure 1A:
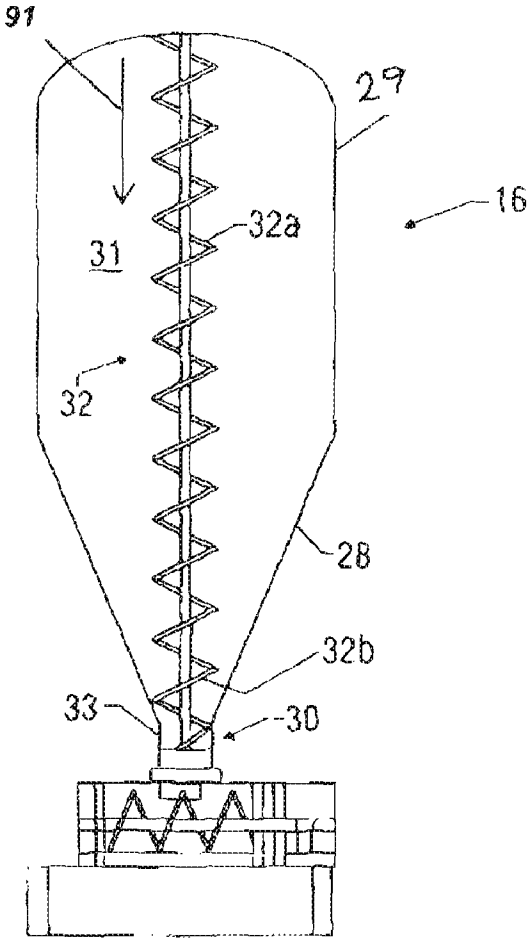
FIG. 1A schematically illustrates a bulk tank in accordance with one embodiment of the present invention.

Referring now to FIGS. 1 and 1A, the bulk tanks 16 receive and store the flow of slurry from the conduit 26. In one embodiment, a bank of bulk tanks 16 are successively filled with slurry from the conduit 26. The slurry flows into the interior volumes of the bulk tanks 16, which are not pressurized. The tanks 16 have an upper cylindrical portion 29, a lower frustoconical portion 28, and a discharge port 30. The upper and lower portions 26, 28 form an internal chamber 31. The frustoconical portion 28 utilizes a sloped shape to assist cuttings flow. The slope angle is selected such that the first drill cuttings that enter into the tank are the first drill cuttings to exit the tank. Thus, the frustoconical portion 28 promotes full flow of slurry through the tank 16. Positioned within the internal chamber 31 is a conveyance member 32 that applies a motive force that impels the slurry out of the bulk tanks 16. The discharge port 30 includes a suitable valve assembly (not shown) that allows the slurry to exit the interior of the bulk tanks 16. The filling of the bulk tanks 16 can be controlled manually, automatically or a combination thereof. In one arrangement, a controller 34 receives signals from sensors 36 positioned on the bulk tanks 16. The sensor signals indicate the amount of slurry in the bulk tanks 16. Thus, in one arrangement, a controller 34 can have a programmable logic circuit (PLC) that directs flow into a bulk tank 16 until the associated sensor 36 indicates that the bulk tank 16 is full. Thereafter, the PLC stops flow to the bulk tank 16 by actuating appropriate valves and initiates flow into the next bulk tank 16. This process can continue until all of the bulk tanks 16 are filled. While a sequential filling process has been described, it should be appreciated that two or more bulk tanks 16 can be filled at the same time. While in some embodiments, the tank can be constructed to hold 100 BBL of drill cuttings having a specific gravity of 2.34, other sizes and configurations can also be used.

As noted earlier, the slurry can be relatively viscous and not flow effectively under the effect of only gravity. Therefore, the conveyance member 32 is positioned within the internal chamber 31 of the bulk tanks 16 to impel the slurry through the bulk tanks 16 after the port 30 is opened. In the FIG. 1 embodiment, the conveyance member 32 is at least partially immersed in the slurry and exerts a motive force throughout the body of the slurry as opposed to, for example, a positive pressure applied on the top of the slurry body and/or a suction applied to the bottom of the slurry body. Thus, in this arrangement, the conveyance member 32 provides an internal and vertically distributed motive force for the slurry body.

In one embodiment, the conveyance member 32 is a screw conveyor driven by a motor drive (not shown). A screw flight portion extends from an upper portion of the chamber 31 and terminates adjacent the discharge port 30. Rotation of the screw propels the slurry downward and out through the discharge port 30. The tank 16 can also incorporate a relatively straight portion 33 adjacent the frustoconical portion 28 to allow the conveyance member 32 to pull the slurry through the reduced diameter sections of the tank 16. Thus, the conveyance member 32 can have a relatively larger diameter portion 32A in the upper section of the tank 16 and a reduced diameter portion 32B in the lower section of the tank 16. That is, the diameter of the conveyance member 32 can correspond with the diameter or shape of the tank 16 to enhance flow through the tank 16 and reduce potential areas wherein slurry can settle.

In some arrangements, the conveyance member 32 is right and left hand reversible. In the right hand rotation mode, the slurry flows downward to the port 30. In the left hand rotation mode, the slurry is mixed to maintain material consistency. This is advantageous when the slurry is stored for long periods of time, since heavier material will settle to the tank bottom and lighter fluids will flow to the top. This stratification of materials can make it difficult to empty the tank of the slurry. In such circumstances, the left hand rotation will mix the slurry and enable the slurry to flow of the tank.

While the conveyance member 32 is shown as concentrically positioned and extending through substantially all of the bulk tank 16, other suitable configurations could include an eccentrically positioned member or a member that extends only partially through the bulk tank 16. In still other embodiments, two or more conveyance members can cooperate to expel the slurry out of the bulk tank 16. A screw or auger is merely one illustrative member suitable for applying a motive force throughout the body of the slurry. In still other embodiments, the conveyance member 32 can be positioned adjacent an inner wall of the bulk tank. Thus, it should be appreciated that the conveyance member 32 positioned within the bulk tank is susceptible to numerous variations that can adequately apply a motive force vertically across the slurry body to expel the slurry out of the bulk tank 16. The slurry so expelled flows out of the bulk tanks 16 and into the cuttings flow unit 14. An auger or other conveyor mechanism conveys the slurry from the bulk tanks 16 via the conduit 26 to containers on a transport vessel 30. Suitable conveyor mechanisms include pneumatic systems, progressive cavity pumps, and vacuum pumping systems.

Figure 2:
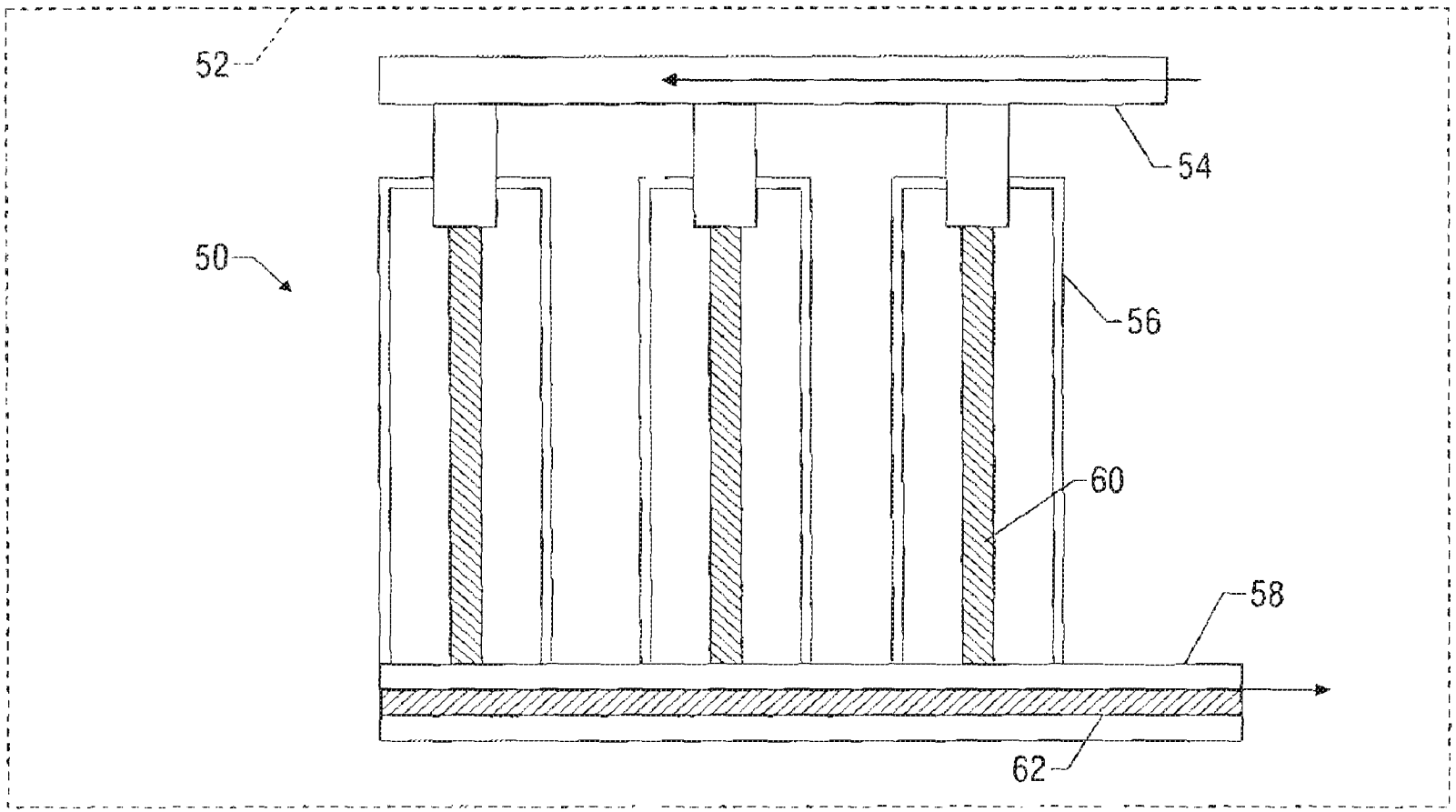
FIG. 2 schematically illustrates a storage container on a transport vessel or vehicle made in accordance with one embodiment of the present invention.

Referring now to FIG. 2, there is schematically illustrated one embodiment of a cuttings handling system 50 that can be fitted on a suitable land or water transportation vessel/vehicle 52. The system 50 includes a manifold 54 that can be connected to the conduit 26 (FIG. 1), storage tanks 56, and a main discharge line 58. In one embodiment, the tanks 56 each have an internal flow device 60 such as an auger that actively force the cuttings out of the tanks 56. Likewise, the main discharge line 58 can include a flow device 62 such as an auger to convey cuttings from the tanks 56 to a selected location. The tanks 56 can, for example, have a 250 BBL capacity and the main discharge line 62 can be configured to flow 25 tons per hour.

Figure 3:
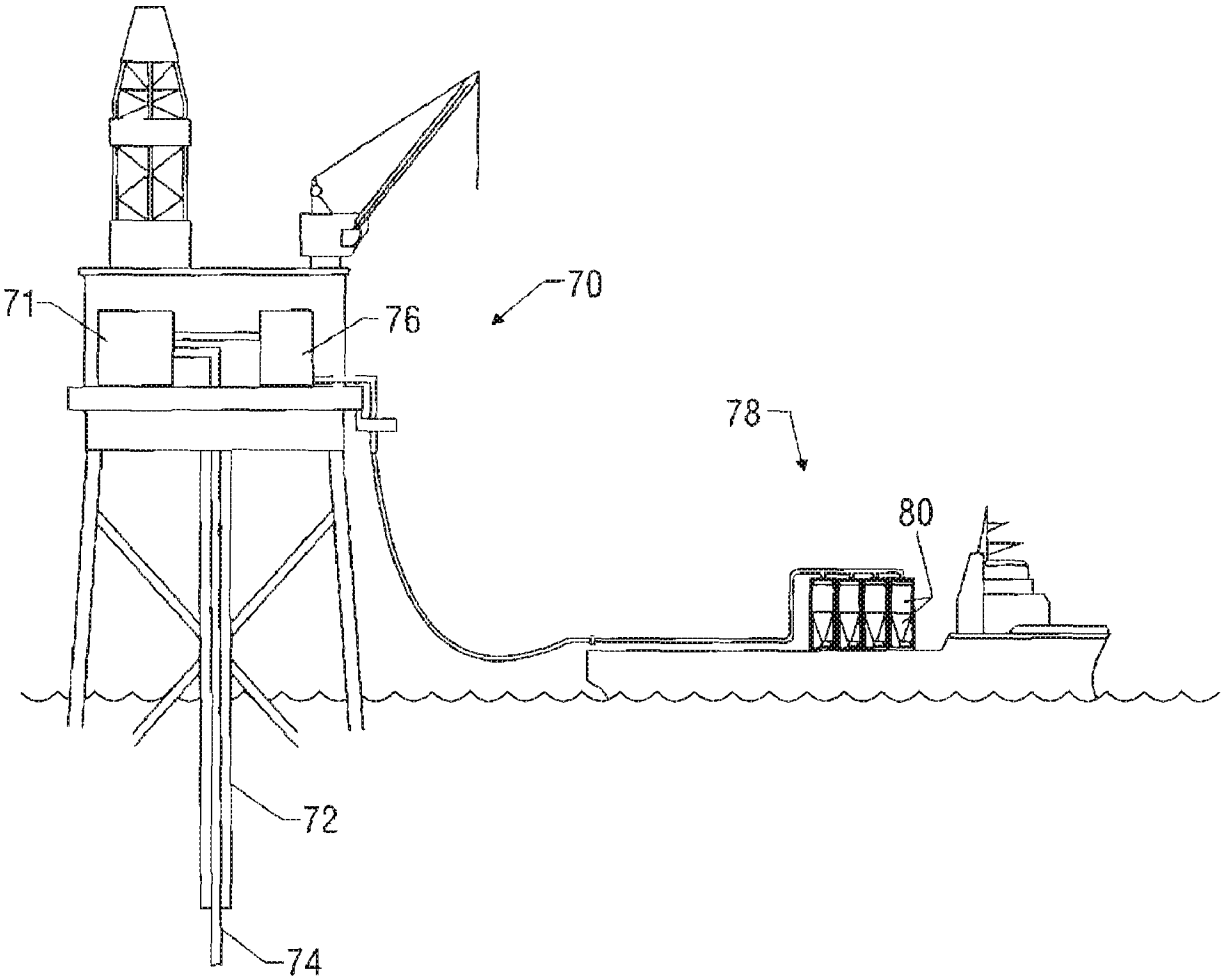
FIG. 3 schematically illustrates an offshore drilling facility using a cuttings handling system made in accordance with one embodiment of the present invention.

Referring now to FIG. 3, there is shown an embodiment of the present invention that is suited for offshore drilling applications. As is known, subsea drilling operations utilize a surface facility such as an offshore rig 70 from which a riser 72 or other device conveys a drill string 74 into a subsea well (not shown). Positioned on the offshore rig 70 is cuttings handling system 71 that processes the return fluid from the subsea wellbore (not shown) using equipment previously discussed and conveys a cuttings slurry to a bank of bulk tanks 76. During drilling, the return fluid is processed and the slurry continuously conveyed and stored in the bulk tanks 76. A controller fills the bulk tanks 76 using preprogrammed instructions and signals from suitably positioned sensors. Periodically, a transport vessel 78 such as a barge is moored adjacent the rig 70 and storage tanks 80 in the barge 78 are connected to the cuttings handling system 71. If the slurry in the tanks has been stored for a long period, then the conveyance device 32 is operated in a mixing mode to homogenize the slurry body. Thereafter, the ports of the bulk tanks 76 are opened and the cuttings handling system 71 offloads the cuttings to the barge 78.

Figure 4:
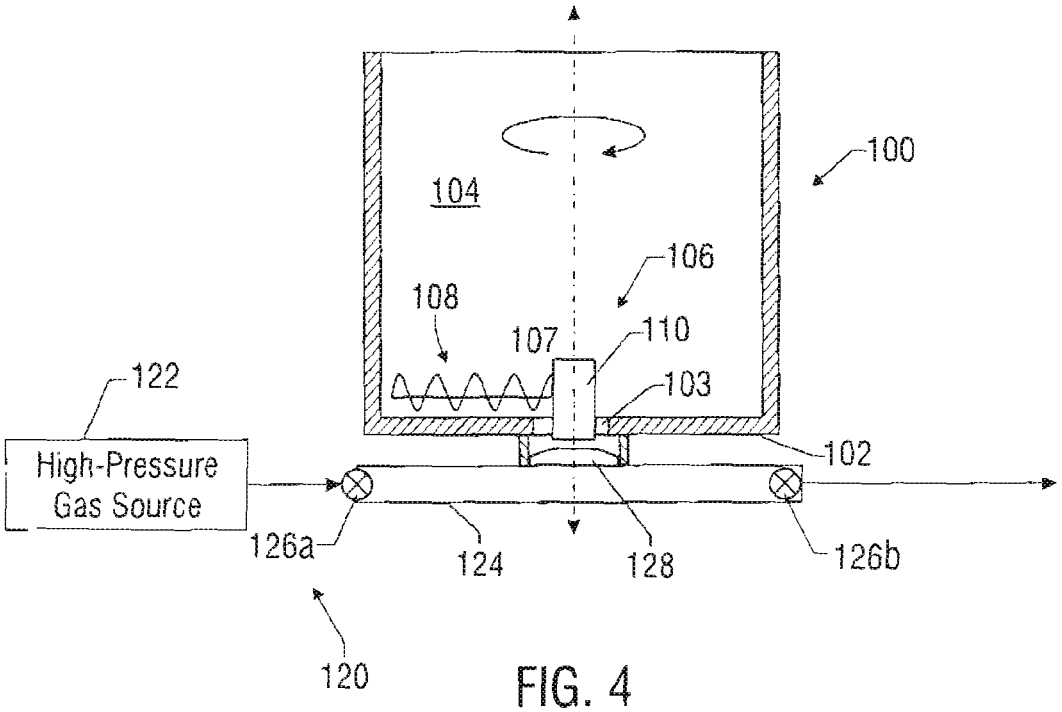
FIG. 4 schematically illustrates a bulk tank in accordance with one embodiment of the present invention that includes flow control elements.

Referring now to FIG. 4, there is shown another embodiment of a bulk tanks 100 made in accordance with the present invention. The tank 100 is cylindrically shaped and has a substantially flat base or bottom 102 that includes a discharge port 103. It should be appreciated that a tank having a flat bottom 102 presents a lower vertical profile than a tank of similar volume having a conical lower portion and enhanced stability due to a lower center of gravity, both of which can be advantageous in shipboard applications. Positioned in the interior 104 of the tank 100 and adjacent the bottom 102 is a multi-action cuttings conveyor 106. The cuttings conveyor 106 dislodges cuttings from the surfaces of the bottom 102 and also actively urges the dislodged cuttings toward the discharge port 103. In one embodiment, the cuttings conveyor 106 includes a radial arm 107 having a rotating auger 108. A planetary gear drive 110 or other suitable rotation device rotates the arm 107 such that the auger 108 sweeps the surface of the bottom 102. During this sweeping action, cuttings accumulate across the arm 107. The rotating action of the auger 108 pushes or plows the accumulated cuttings from the radially outward edges toward the center of the bottom 102 and discharge port 103. In lieu of an auger, the arm can include rake-like fingers or other members that can displace cuttings toward the discharge port 103. Thus, the multi-action of the cuttings conveyor 106 includes at least rotational motion of the arm and radial movement along the arm. The arm 107 can rotate continuously or intermittently, reverse rotational direction, and/or sweep through a preset arc.

The cuttings can be continuously conveyed from the tank 100 using devices previously described in connection with FIGS. 1 and 1A. Alternatively, cuttings can be conveyed using an intermittent operation fluid displacement system 120. In one embodiment, the system 120 includes a high-pressure air source such as a compressor 122 that provides high-pressure air, a sump or reservoir 124, isolation valves 126*a,b*, and a one-way check valve 128 in communication with the discharge port 103. During operation, the one-way check valve 128 is opened to allow cuttings to drain from the tank 100 and closed after a sufficient quantity of cuttings flows into the reservoir 124. Next, the isolation valve 126*a* is opened and the compressor 122 is energized to pressurize the reservoir 124. Once the appropriate pressure has been reached, the isolation valve 126*a* is closed and the isolation valve 126*b* is opened, which allows the cuttings to be expelled out of the reservoir 124. A PLC can be used to automate the cuttings evacuation and conveyance process. E.G., the PLC can be programmed to provide a preset number of periodic bursts or slugs of cuttings per selected time period.

Figure 5:
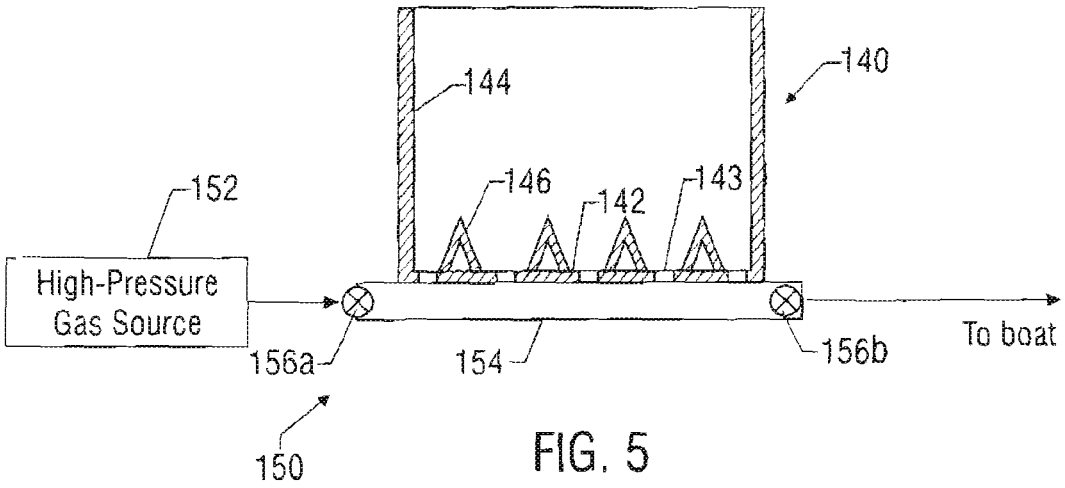
FIG. 5 schematically illustrates a bulk tank in accordance with one embodiment of the present invention that uses a multi-action conveyor.

Referring now to FIG. 5, there is shown another embodiment of a bulk tank 140 made in accordance with the present invention. The tank 140 is cylindrically shaped and has a substantially flat base or bottom 142 that includes discharge ports 143. Positioned in the interior 144 of the tank 140 and adjacent the bottom 142 are a plurality of cuttings flow control elements 146. The flow control elements 146 present highly inclined surfaces projecting from the tank bottom 142 that direct or channel cuttings into the ports 143. In one embodiment, the flow control elements 146 include cones that project vertically from the bottom 142. The flow control elements 146 minimize the likelihood that cuttings will accumulate on the interior surfaces of the tank 140. The discharge ports 143 are openings formed in the tank bottom 142 that can be selectively opened and closed using suitable occlusion members or valve assemblies (not shown). Like the FIG. 4 embodiment, the cuttings discharged via the ports 143 can be conveyed using an intermittent operation fluid displacement system 150 that includes a high-pressure-air source 152 that provides high-pressure air, a sump or reservoir 154, isolation valves 156*a,b*, and a one-way check valve 158 in communication with the discharge ports 153. Operation of the system 150 is similar to that described in reference to FIG. 4.

Referring now to FIG. 1A, in addition to the devices positioned within the bulk tanks 16 that expel cuttings by physically co-acting with the cuttings body, the cuttings body can be pressurized by air 91. That is, in certain embodiments, there can be pressure-assisted evacuation of the bulk tanks 16.

It should be appreciated that the cuttings handling systems described above offers enhanced safety due to the reduced number of handling operations such as interventions by personnel to hook up containers to the crane, manual shoveling of cuttings into containers, transfers of containers around the rig floor, use of the crane rig, etc. Furthermore, the transport vessel to which the slurry is offloaded is only temporarily moored adjacent the rig. A continuously moored transport vessel could pose a hazard to the rig and itself during rough seas. Thus, reducing the time the transport vessel is moored to the rig also reduces the risk that inclement weather interfere with drilling operations.

While the foregoing disclosure is directed to the preferred embodiments of the invention, various modifications will be apparent to those skilled in the art. It is intended that all variations within the scope of the appended claims be embraced by the foregoing disclosure.

What is claimed is:

1. A system for handling a return fluid formed of drilling fluid and entrained cuttings recovered while drilling a wellbore in an earthen formation, comprising:

a separation unit at least partially separating the drilling fluid from the return fluid, a slurry of cuttings thereby being formed, the separation unit including:

(i) a shaker for removing the entrained cuttings from the return fluid; and (ii) a separator for extracting the drilling fluids from the entrained cuttings;

a cutting flow unit receiving a slurry from the separation unit, the cutting flow unit adapted to convey the slurry through a conduit coupled thereto, the cutting flow unit including at least a dense phase blower;

at least one bulk tank coupled to the conduit, each bulk tank having (i) an interior volume receiving the slurry and (ii) a discharge port selectively restricting flow of the slurry out of each bulk tank, the return fluid being contained in the interior volume at least until the discharge port is opened, the slurry forming a body in the interior volume;

a conveyance member positioning inside each bulk tank, the conveyance member applying a motive force at least partially across the slurry body that causes the slurry body to flow out of each bulk tank discharge port; and a conveyor receiving the slurry from each bulk tank discharge port;

wherein the system is positioned on an offshore drill rig, and wherein the cuttings flow unit includes a diverter valve configured to selectively direct flow to the at least one bulk tank and a transport vessel having at least one container receiving the slurry from the at least one bulk tank via the diverter valve.

2. The system of claim 1, wherein the conveyance member is a screw conveyor that extends from an upper portion of the at least one bulk tank and terminates at each bulk tank discharge port.

3. The system of claim 2 further comprising a controller controlling the flow of the slurry into the at least one bulk tank.

4. The system of claim 3 further comprising a sensor positioned on each bulk tank, the sensor producing a signal indicative of a volume of return fluid in the associated bulk tank, the controller controlling the flow of the slurry in response to the sensor signals.

5. The system of claim 1, wherein the conveyance member operates in a mixing mode that mixes the slurry.

6. The system of claim 1, wherein the conveyance member includes a screw flight portion that applies a vertical motive force to a slurry body, the motive force being at least partially across the slurry body.

7. The system of claim 1, wherein the conveyance member is adapted to be at least partially immersed in the slurry body.

* * * * *